US005551399A

United States Patent [19]

Collingborn

[11] Patent Number: 5,551,399

[45] Date of Patent: Sep. 3, 1996

[54] ADVANCE PISTON MOUNTING

[75] Inventor: Peter A. G. Collingborn, Kent, England

[73] Assignee: Lucas Industries public limited company, West Midlands, England

[21] Appl. No.: 499,972

[22] Filed: Jul. 10, 1995

[30] Foreign Application Priority Data

Jul. 12, 1994 [GB] United Kingdom ..... 9413994

[51] Int. Cl.[6] ..... F02M 41/00; F02M 37/04

[52] U.S. Cl. ..... 123/450; 123/502

[58] Field of Search ..... 123/450, 502, 123/500–501; 417/218, 219

[56] References Cited

U.S. PATENT DOCUMENTS

| | | | |
|---|---|---|---|
| 3,771,506 | 11/1973 | Davis | 123/502 |
| 4,037,574 | 7/1977 | Swift | 123/502 |
| 4,041,919 | 8/1977 | Bonin | 123/502 |
| 4,079,719 | 3/1978 | Varcoe et al. | 123/502 |
| 4,473,053 | 9/1984 | Shinoda | 123/502 |
| 4,535,745 | 8/1985 | Roca Nierga | 123/502 |
| 4,538,581 | 9/1985 | Hakansson | 123/502 |
| 4,594,988 | 6/1986 | Tompkins, Jr. et al. | 123/502 |
| 4,748,958 | 6/1988 | Ash et al. | 123/502 |

FOREIGN PATENT DOCUMENTS

| | | |
|---|---|---|
| A467808 | 6/1937 | United Kingdom . |
| A914532 | 1/1963 | United Kingdom . |
| A2194849 | 3/1988 | United Kingdom . |

*Primary Examiner*—Thomas N. Moulis

*Attorney, Agent, or Firm*—Trexler, Bushnell, Giangiorgi & Blackstone, Ltd.

[57] ABSTRACT

A mounting for an advance piston comprises a sleeve having flanges arranged to extend outwardly and arranged to engage a pump housing in order to secure the sleeve thereto, the sleeve extending within a passage provided in the pump housing. One or more of the flanges may be securable to the sleeve for example, by screw threaded engagement, or by means of bolts.

10 Claims, 3 Drawing Sheets

ADVANCE PISTON MOUNTING

This invention relates to a mounting arrangement for the advance timing piston of a distributor pump for use in the distribution of fuel to the cylinders of a diesel internal combustion engine.

A known form of distributor pump of a diesel engine commonly comprises a rotatable distributor member arranged to rotate in timed relation with the associated engine. The distributor member rotates within a sleeve including inlet and delivery ports, the distributor member including passages arranged to communicate with the ports of the sleeve in turn on rotation of the distributor member. The distributor member includes an end region arranged to rotate within a cam ring provided with a plurality of cam lobes on the inner surface thereof, the end region being provided with a plurality of radially extending bores. A plunger is provided in each of the bores and arranged to perform reciprocating motion, the outer end of each plunger being provided with a shoe housing a roller arranged to engage with the cam lobes of the cam ring on rotation of the distributor member.

In use, fuel is supplied to the inlet port, and from there to the bores of the distributor member when the inlet port aligns with a corresponding passage of the distributor member. Rotation of the distributor member cuts off the communication with the inlet port and in turn results in the rollers engaging with the cam lobes pushing the plungers into the bores and pumping fuel from the distributor member through a delivery port which by that stage has come into alignment with a corresponding passage of the distributor member.

The distributor member, sleeve and cam ring are located within a housing which includes a bore or passage extending transverse to the axis of the distributor member and cam ring, a fluid pressure operable advance piston being provided within the bore. In order to adjust the time at which fuel is delivered to the cylinders of the engine, the cam ring is angularly adjustable, movement of the cam ring occurring as a result of the engagement of a peg secured to the cam ring with the advance piston. When a change in the timing is desired, the fluid pressure applied to the piston is varied and the movement of the piston is transmitted to the cam ring. Such movement adjusts the position of the cam lobes, and hence the time at which the rollers come into engagement with the cam lobes to effect inward movement of the plungers.

In another form of distributor pump, the rotary distributor member is also axially movable and forms the pumping element of the pump. The distributor member is provided with a face cam having cam lobes which cooperate with rollers to move the distributor member in the pumping direction the return motion being effected by a spring. The rollers are mounted in a cage which is angularly adjustable about the axis of rotation of the distributor member for the purpose of varying the timing of fuel delivery. The angular setting of the cage is determined by an advance piston.

The pumps are commonly provided with a non-ferrous housing, for example an aluminium housing, and one disadvantage with such a pump if the bore is machined in the housing is the possibility of excessive leakage of fluid due to wear of the bore and due to the differences in the thermal expansivities of the housing and the advance piston. Excessive leakage results in impaired performance.

OBJECTS AND SUMMARY

According to the present invention there is provided a mounting for an advance piston wherein the advance piston is provided in a sleeve provided with outwardly extending flanges for securing the sleeve to the housing of a pump.

One of the flanges may be integral with the sleeve, the other flange being arranged to be secured thereto, the sleeve and the non-integral flange preferably being provided with screw threaded regions arranged to engage with one another to secure the flange to the sleeve.

Alternatively, both of the flanges may be securable to the sleeve, the flanges being provided with apertures for the reception of bolts engageable within threaded holes in the pump housing.

The invention will further be described, by way of example, with reference to the accompanying drawings in which like reference numerals denote like parts, and in which:

DESCRIPTION

Figure 1:
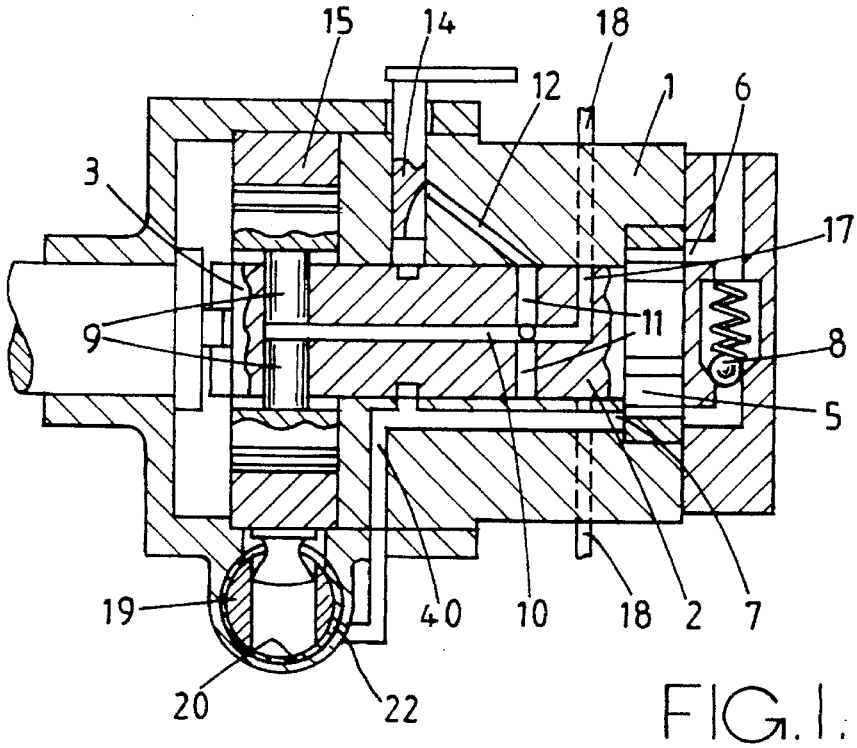
FIG. 1 is a cross-sectional view of a distributor pump including a mounting arrangement according to a first embodiment of the invention.

Referring to FIG. 1, the pump comprises a body part 1 in which is mounted a rotary cylindrical distributor member 2 having formed at one end a head 3 mounting in a bore, a pair of reciprocable pumping plungers 9. The pumping plungers 9 are arranged to be moved inwardly as the distributor member is rotated by the action of a plurality of cam lobes projecting inwardly of the internal peripheral surface of an annular cam ring 15 which surrounds the distributor member. Also formed in the distributor member is a longitudinal bore 10 which at one point is in communication with an outwardly extending delivery passage 17 which is arranged to register in turn, as the distributor member rotates, with a plurality of outlet ports 18 which in use are connected to injection nozzles respectively mounted on the associated engine.

At another point the longitudinal passage is in communication with a plurality of equi-angularly disposed and radially extending inlet passages 11 which register in turn, as the distributor member rotates, with an inlet port 12 formed in the body part. The communication between an inlet passage 11 and an inlet port 12 occurs during the time when the plungers 9 are permitted to move outwardly by the cam lobes and the communication of the delivery passage 17 with one of the outlet ports 18 occurs prior to inward movement of the plungers by the action of the cam lobes. It will be noted that the plungers 9 at their outer ends engage shoes which carry rollers the axes of the rollers being disposed parallel to the axis of rotation of the distributor member.

At the opposite end of the distributor member to the bore which accommodates the plungers, is mounted the rotor of a vane type feed pump 5 having an inlet 6 and an outlet 7 in the body part. The inlet 6 of the feed pump in use is connected to a source of liquid fuel and the inlet and outlet are interconnected by way of a valve 8 which controls the output pressure of the feed pump in such a manner that it varies in accordance with the speed at which the apparatus is driven. Since the distributor member is driven by the engine the output pressure of the feed pump is also dependent upon the speed of the engine and the outlet of the feed pump is in communication with aforesaid inlet port 12 by way of an adjustable throttle valve 14 whereby the quantity of fuel which flows through the inlet port 12 whilst the plungers are capable of moving outwardly can be varied. The throttle valve consists of an angularly adjustable cylindrical member the setting of which is controlled by a speed responsive governor (not shown). The cam ring 15 is angularly adjustable within the body part for the purpose of varying the timing of delivery of fuel to the engine. The cam ring is connected to a fluid pressure operable piston 19 which is mounted within a sleeve 22 located within a cylindrical bore 20 which is tangentially disposed relative to the cam ring 15. The piston 19 is loaded by a coiled compression spring 44 towards the retarded position and a passage 40 connects the outlet 7 of the feed pump with the bore 20 so that the position of the piston 19 is dependent upon the outlet pressure of the pump.

Figure 2:
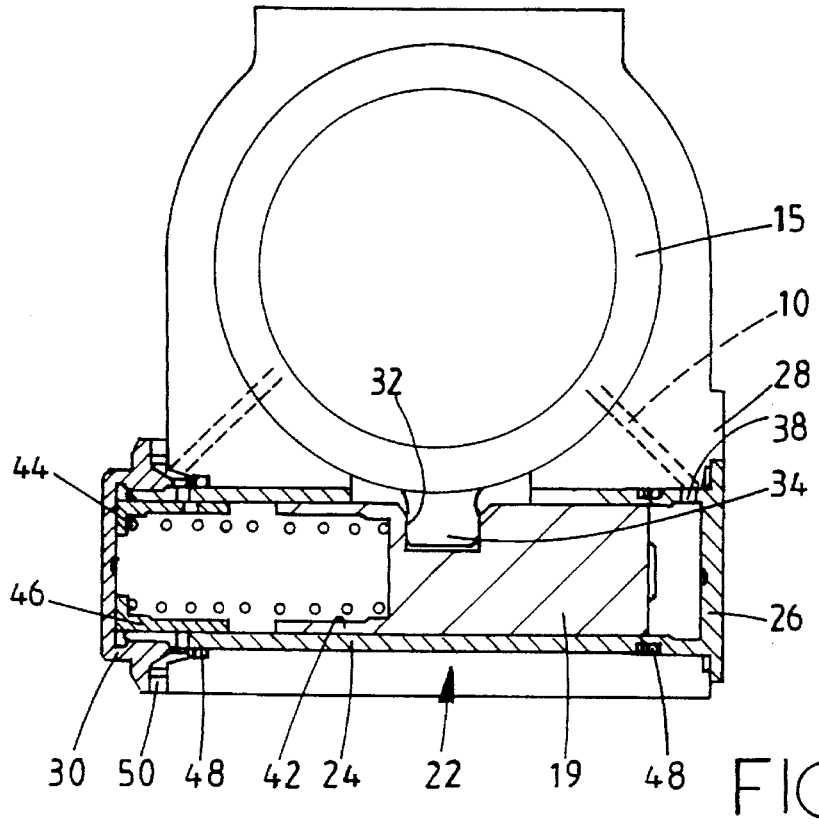
FIG. 2 is a cross-sectional view of part of a distributor pump of FIG. 1.

The sleeve 22 illustrated in FIG. 2 comprises a steel tube 24 one end of which is closed by an integral flange 26 which extends radially outwardly of the tube 24 in addition to closing the end thereof. The flange 26 is of hexagonal cross section, one of the flat sides of the flange 26 being arranged to engage with a raised portion 28 of the housing in order to locate the sleeve 22 correctly. The open end of the tube 24 is provided with an externally screw threaded region which protrudes from the housing. An internally screw threaded nut 30 is arranged to engage with the screw threaded region of the tube 24, the nut 30 extending radially outwardly of the bore. In order to facilitate fastening the nut 30 to the tube 24, the nut 30 is provided with a region of hexagonal cross-section arranged to be engaged by a spanner or other suitable tool.

The centre portion of the tube 24 is provided with an opening through which the peg 34 of the cam ring 15 extends, in use.

The tube 24 houses the advance piston 19 which includes a recess 32 within which the peg 34 is arranged to engage. The tube 24 is provided with an aperture 38 between the advance piston 19 and the integral flange 26, the aperture 38 communicating with a passage 40 provided in the housing for carrying fuel under pressure from the outlet 7 of the feed pump 5 to the sleeve 22 in order to move the piston 19 to adjust the position of the cam ring 15. The end of the advance piston 19 remote from the integral flange 26 of the sleeve 22 is provided with an axially extending cylindrical bore 42 housing an end of a return spring 44, the other end of the spring 44 bearing against an inwardly extending flange of a hollow cylindrical member 46 which in turn bears against the inner surface of the nut 30. The part of the sleeve 22 housing the spring 44 is arranged to communicate with a part of the interior of the housing at low fuel pressure.

Since the pressure of fuel in the passage 40 is dependent upon the speed of operation of the feed pump 5, and hence upon the speed of the engine, an increase in engine speed results in the application of high pressure fuel to the piston through the aperture 38 pushing the advance piston 19 to the left as shown in FIG. 2. Such movement adjusts the position of the cam ring 15 advancing the timing of fuel delivery to the engine, and in addition compresses the spring 44. Movement of the piston 19 to the left is restricted by the end of the piston 19 engaging with the cylindrical member 46.

On reducing engine speed, the pressure in the passage 40 reduces, the piston 19 moving to the right under the action of the spring moving the cam ring in an anticlockwise direction retarding the timing of fuel delivery to the engine.

Suitable seals 48 are provided in order to prevent leakage of fuel from the pump between the sleeve 22 and the housing, and a sealant 50 is applied to seal the nut 30 to housing.

Figure 3:
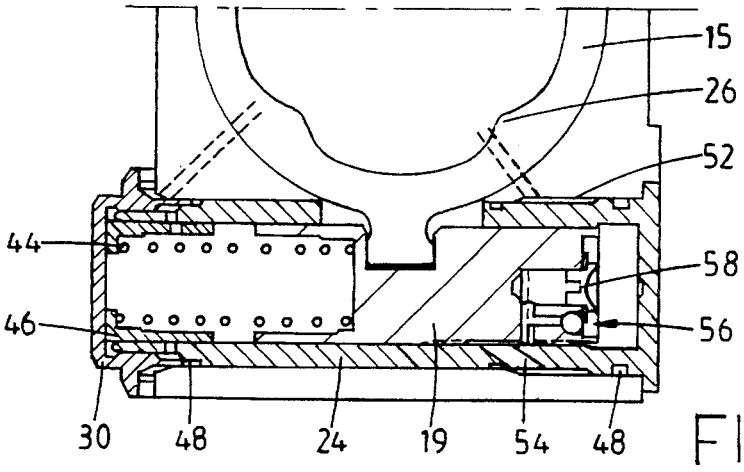
FIGS. 3 to 7 are views similar to FIG. 2 of second, third, fourth, fifth and sixth embodiments.

The embodiment illustrated in FIG. 3 is similar to that illustrated in FIG. 2, the aperture 38 for applying fuel to the advance piston 19 being replaced by an annular passage 52 between the housing and the tube 24, and a port 54 which is arranged to supply the fuel to a shock valve 56 provided within the advance piston 19. It will be recognised that in use, when the rollers come into contact with the cam lobes 26, a large force is applied to the cam ring 15 which tends to move the cam ring 15 in an anticlockwise direction, this being the direction of rotation of the distributor member. The shock valve 56 is, in effect, a non-return valve which closes on the application of very high pressure to the piston 19 such as occurs when the rollers contact the cam lobes 26, substantially preventing movement of the piston 19 to the right. A small drain 58 is provided in parallel with the shock valve 56 which together with leakage, allows fuel to flow from the cylinder containing the piston when the fuel pressure falls. With a fall in the fuel pressure the piston moves towards the right under the action of the spring 44.

Figure 4:
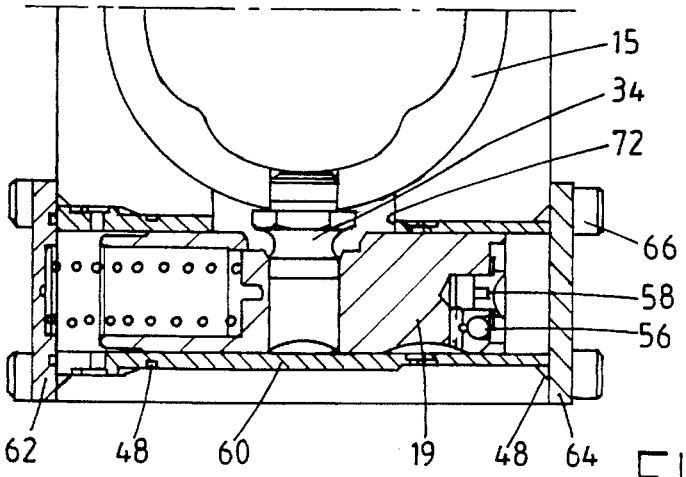
Figure 5:
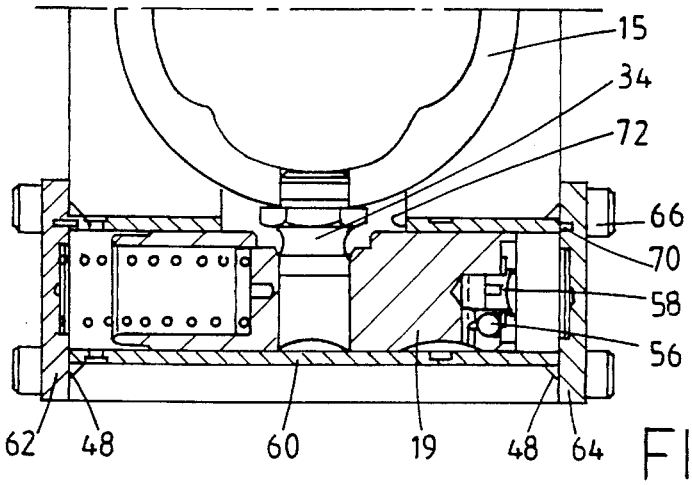
Figure 7:
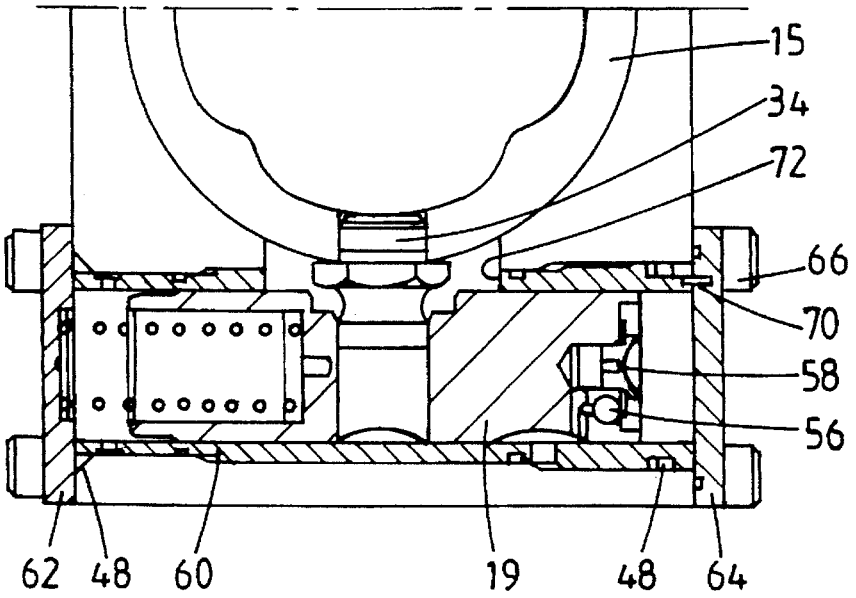

The sleeves illustrated in FIGS. 4, 5 and 7 each comprises a steel tube 60, the ends of which are closed, in use, by a pair of steel discs or rectangular plates 62, 64 each of which includes a plurality of apertures for the reception of bolts 66 engageable within threaded holes in the housing. The discs 62, 64 therefore engage the ends of the tube 60 and being larger than the bore of the housing, prevent the tube 60, when assembled, from leaving the bore.

In the embodiments of FIGS. 5 and 7, dowels or pins 70 are provided to align the tube 60 with the disc(s) 62, 64 in order to ensure that the tube 60 is positioned correctly with the opening 72 aligned with the opening of the housing permitting the peg 34 of the cam ring 15 to engage with the advance piston 19.

In each of the embodiments, suitable seals 48 are provided in order to prevent leakage of fuel from the pump.

Figure 6:
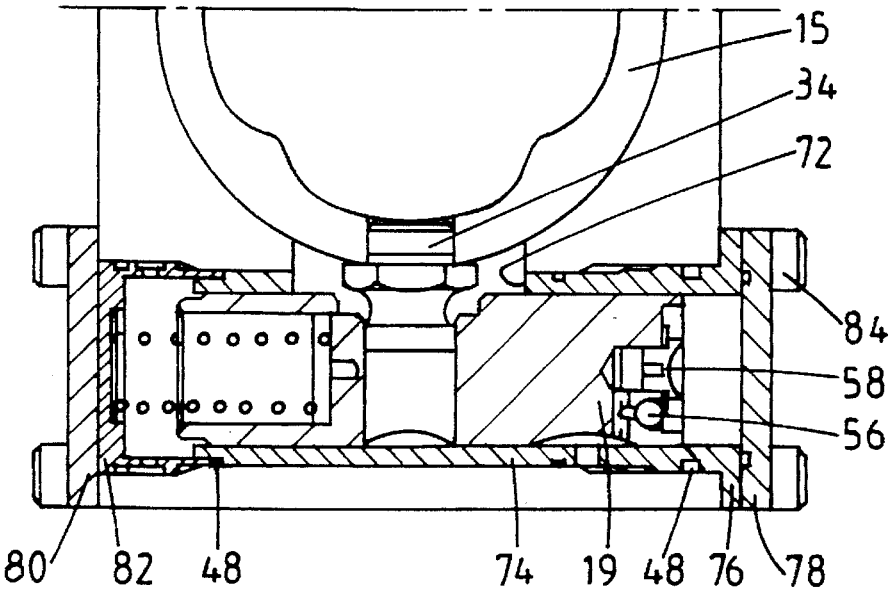

FIG. 6 shows an embodiment in which the sleeve 22 comprises a tube 74 provided with an outwardly extending flange 76 at an end thereof arranged to engage with the outer surface of the housing, the tube 74 being closed, in use, by a steel disc 78. The other end of the bore is closed by a second steel disc 80, a hollow cylindrical member 82 having one end closed by an integral wall being held captive within the bore by the second disc 80. If desired, the disc 80 and member 82 may be integral with one another. In order to secure the sleeve 22 in position, the steel discs 78, 80 and the outwardly extending flange 76 are provided with a plurality of apertures for the reception of bolts 84 engaged within threaded holes in the housing.

A helical spring is arranged to return the advance piston 19 to the right as in the other embodiments.

Each of the embodiments illustrated in FIGS. 4 to 7 include the shock valve 56 and drain 58 of the second embodiment. If desired, the valve 56 and drain 58 may be omitted, or replaced by a similar valve provided in the passage of the housing carrying fuel from the housing to the sleeve, and such a valve 56 and drain 58 may be included in the embodiment of FIG. 2.

In each of the embodiments, the sleeve 22 and advance piston 19 are both constructed of steel or another ferrous material. If the piston 19 and sleeve 22 are subjected to similar temperature increases, the thermal expansion which occurs does not significantly increase the clearance between the piston 19 and the sleeve 22 due to the piston 19 and sleeve 22 having substantially equal thermal expansion rates. It will be understood that by maintaining a substantially constant clearance with varying temperature results in a reduction in the quantity of fuel escaping between the piston 19 and sleeve 22. Further, by using materials of similar hardness, less wear occurs due to the sliding movement than occurs in the conventional arrangements.

The invention claimed is:

1. A mounting for an advance piston comprising a sleeve within which the advance piston is provided, the sleeve being provided with a first outwardly extending flange integral with the sleeve, and a second outwardly extending flange arranged to be secured to the sleeve, the first and the second flanges being arranged to secure the sleeve to a pump housing.

2. A mounting as claimed in claim 1, wherein the second flange and the sleeve are provided with screw threaded regions arranged to mate with one another in order to secure the second flange to the sleeve.

3. A mounting as claimed in claim 1, wherein first and second ones of the flanges are securable to the sleeve.

4. A mounting for an advance piston comprising a sleeve within which the advance piston is provided, and first and second outwardly extending flanges securable to the sleeve to secure the sleeve to a pump housing, wherein at least one of the first and second flanges is securable to the sleeve by means of bolts arranged to extend through respective apertures provided in each flange, the bolts being arranged to be received by threaded openings provided in the pump housing.

5. A mounting as claimed in claim 4, further comprising at least one locator pin, for locating each flange with respect to the sleeve.

6. A mounting for an advance piston comprising a sleeve within which the advance piston is provided, first and second outwardly extending flanges securable to the sleeve to secure the sleeve to a pump housing, and at least one locator pin for locating a respective one of the flanges with respect to the sleeve.

7. A mounting as claimed in any one of the preceding claims, wherein the sleeve and the advance piston are constructed of materials of substantially identical thermal expansivity.

8. A mounting as claimed in claim 7, wherein the sleeve and the advance piston are both constructed of a ferrous material.

9. A mounting as claimed in any one of claims 1–5 or 6, the mounting in combination with an advance arrangement comprising a housing having a passage extending therein, the sleeve of the mounting being received within the passage.

10. A mounting for an advance piston comprising a sleeve within which the advance piston is provided, the sleeve including an integral outwardly extending flange for securing the sleeve to a pump housing, the flange being securable to the housing by means of bolts arranged to extend through respective apertures provided in the flange and to be received by threaded openings provided in the pump housing.

* * * * *